US005366096A

United States Patent [19]

Miller

[11] Patent Number: 5,366,096

[45] Date of Patent: Nov. 22, 1994

[54] APPARATUS FOR AND METHOD OF AUTOMATICALLY DETECTING AND ELIMINATING CIGARETTES WITH VISUAL DEFECTS DURING CIGARETTE MANUFACTURE

[75] Inventor: Lewis H. Miller, Macon, Ga.

[73] Assignee: Brown & Williamson Tobacco Corp., Louisville, Ky.

[21] Appl. No.: 153,705

[22] Filed: Nov. 17, 1993

[51] Int. Cl.[5] ..... B07C 5/00

[52] U.S. Cl. ..... 209/535; 209/538

[58] Field of Search ..... 209/912, 535, 537, 538, 209/545, 541, 542, 517, 518

[56] References Cited

U.S. PATENT DOCUMENTS

| | | | |
|---|---|---|---|
| 4,667,831 | 5/1987 | Mattei et al. | 209/535 |
| 4,814,072 | 3/1989 | Wichert et al. | 209/535 |
| 4,915,237 | 4/1990 | Chang et al. | 209/538 |
| 5,209,249 | 7/1989 | Neri | 131/282 |
| 5,288,462 | 5/1992 | Osmalov et al. | 131/280 |

FOREIGN PATENT DOCUMENTS

| | | | |
|---|---|---|---|
| 415154 | 3/1991 | European Pat. Off. | 209/538 |

*Primary Examiner*—Kenneth W. Noland

[57] ABSTRACT

An apparatus for inspecting cylindrically-shaped articles includes the transporting and aligning of cylindrical objects from a random stacked order, carrying them vertically through three visual inspection stations wherein each of the visual inspection stations visually inspects 120° of the circumference of each of the cylindrical objects. Between adjacent visual inspection stations are a pair of belts which intercept the cylindrical objects flowing from one inspection station to another, wherein one of the belts moves at a slower speed than the other of the belts and is maintained at a speed so that the cylindrical objects are rotated 120° during the time they are captured between the two belts.

6 Claims, 2 Drawing Sheets

APPARATUS FOR AND METHOD OF AUTOMATICALLY DETECTING AND ELIMINATING CIGARETTES WITH VISUAL DEFECTS DURING CIGARETTE MANUFACTURE

BACKGROUND OF THE INVENTION

The present invention relates to an apparatus for detecting visual defects in a cigarette during cigarette manufacture.

Cigarette rods coming from a cigarette making machine are generally inspected by visual means along their length and around their circumference to determine visually if the cigarette rods meet certain preselected requirements. Presently, inspection of cigarettes occur by the use of cylindrically shaped drums which transfer the cigarette rods from a maker wherein 180° of the circumferential surface of the cigarette rod is inspected at a time by different types of scanning means as the cigarette rods move from drum to drum. There are a number of apparatuses noted in the prior art which utilize drum to drum inspection, such as U.S. Pat. No. 5,209,249 and U.S. Pat. No. 5,228,462. However, this inspection of 180° of the circumference is compromised by the curvature of the cigarette so that a true, accurate inspection takes place from only about 120° to 130° of the inspection plane. That is, each half is visual or scannable only along 120° of each 180°. Thus, approximately one-third of each visual or scannable half of a cigarette is not inspected by present methods.

SUMMARY OF THE INVENTION

The present invention is directed to an apparatus for the complete inspection of a cigarette rod's total circumference. Further, the present invention provides for visual inspection of the circumference of a cigarette rod at 120° intervals. Even further, the present invention is directed to the inspection of the circumference of cigarette rods with the use of three video cameras, each camera being disposed to take a picture of approximately separate 120° segments of the circumference of a cigarette rod.

More particularly, the present invention provides an apparatus for inspection of cylindrically shaped articles, for example cigarette rods, comprising: a first inspection means, said first inspection means includes means to inspect the first 120° portion of the circumference of said article; a second inspection means, said second inspection means including means to inspect a second 120° portion of the circumference of said article; and, a third inspection means, said third inspection means including means to inspect a third 120° segment of the circumference of said article. Means are provided to rotate each cylindrically shaped article 120° between each inspection means.

BRIEF DESCRIPTION OF THE DRAWINGS

For a better understanding of the present invention, the preferred embodiment of the present invention will be described with reference to the accompanying drawings in which.

DETAILED DESCRIPTION OF PREFERRED EMBODIMENT

Figure 1:
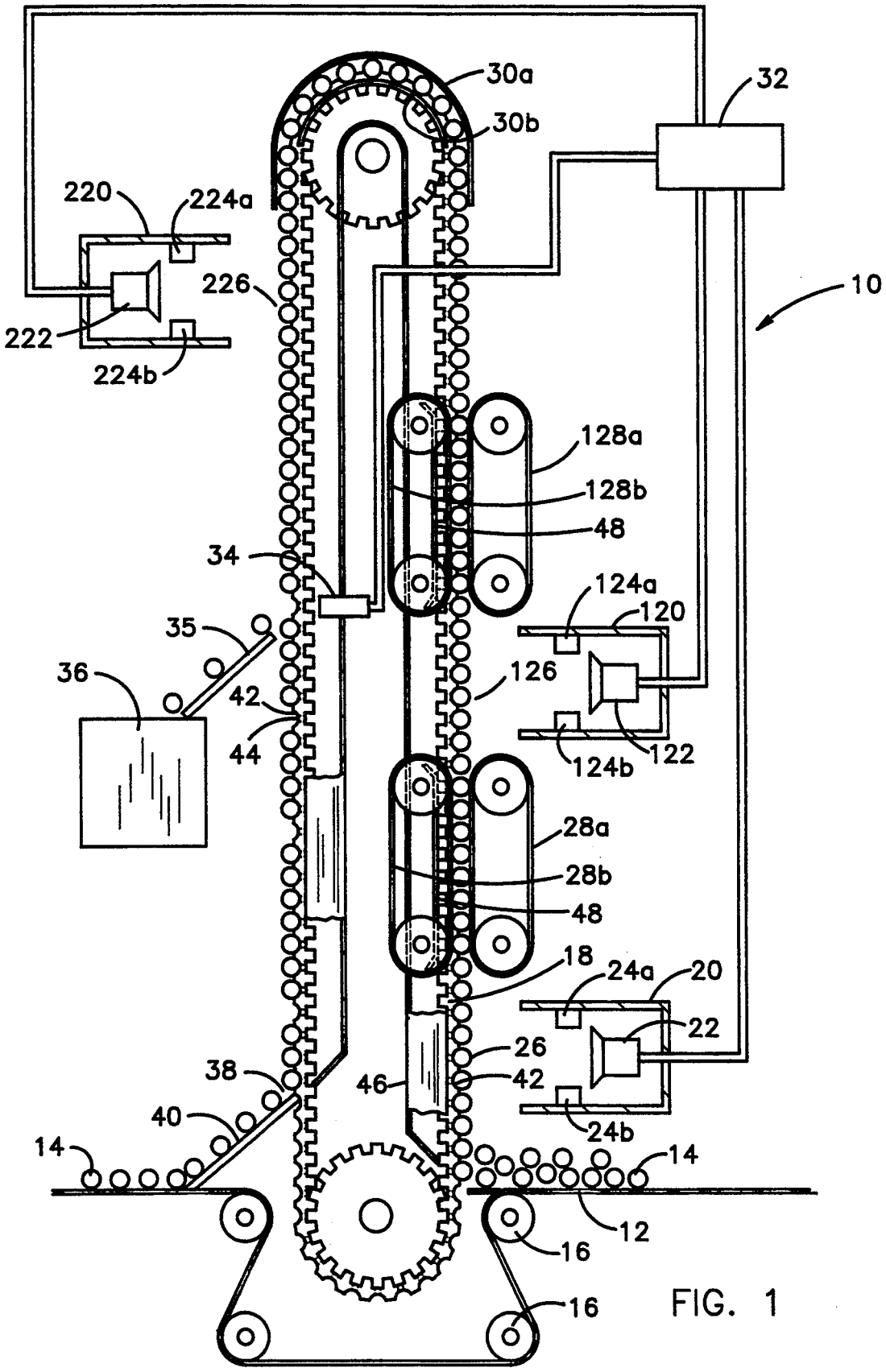
FIG. 1 is a schematic view of a preferred embodiment of the present invention.

In FIG. 1 is shown a schematic of an apparatus 10 for inspecting cylindrically shaped articles, shown as cigarettes 14. Transfer conveyor 12, well known in the art for transporting cigarettes 14, is shown transporting cigarettes 14 from a cigarette making machine (not shown) to a vertically inclined conveyor 18. The transport conveyor 12 is provided with idler rolls 16 positioned so that the transport conveyor 12 acts as the feed conveyor of the inspecting apparatus 10 as well as the discharge conveyor after the cigarettes 14 have been subjected to the hereinafter described inspecting system. The idler rolls 16 are positioned so that the conveyor 12 which feeds cigarettes 14 to and receives discharge from inclined conveyor 18 is in a horizontal position during the transportation of the cigarette products 14.

Figure 2:
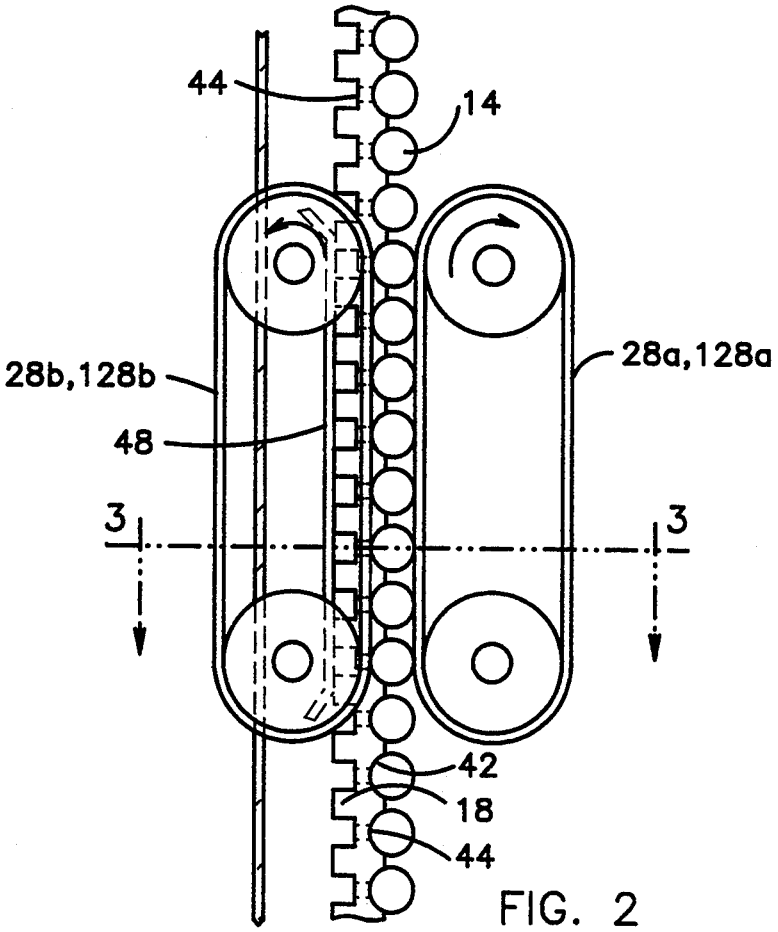
FIG. 2 is an enlarged elevational view of one element of the preferred embodiment of FIG. 1; and, FIG. 3 is a sectional view of FIG. 2 taken along lines 3—3.

The inclined conveyor 18 which is a ribbed hold conveyor which includes grooves 42 therein for receiving individual cigarettes 14 thereon is best shown in FIG. 2. Conveyor 18, an endless loop conveyor, is also provided with an aperture 44 in each groove 42 wherein the aperture 44 is in communication with vacuum source 46. The vacuum source 46 to be discussed hereinafter maintains the cigarettes 14 in a non-rotating position as the cigarettes 14 move upwardly into the inspection zones of the apparatus 10.

Disposed within the inspection apparatus 10 are three inspection stations or enclosures identified by the numerals 20, 120, and 220. Within each enclosure is a video camera 22, 122, 222, respectively, which are aligned to visually image or scan each of the cigarettes 14 passing thereby at the positions noted by the numerals 26, 126, and 226, respectively. Light strobes are provided in each enclosure 20, 120 and 220 to stop the video image visually from moving during the image capture. The light strobes for the enclosure 20 are identified by the numerals **24*a* and 24*b* whereas the light strobes for the enclosure 120 are identified by the numerals 124*a* and 124*b* and for the enclosure 220 are identified by the numerals 224*a* and 224*b*. Video cameras 22, 122, and 222 are in electrical communication with a video processor 32, wherein the video processor 32 stores information submitted thereto from the video cameras 22, 122, and 222. Video processor 32 and the video cameras, 22, 122, and 222 are well known in the art and one preferred video camera and processor manufactured by Itran Corporation and identified as their model number MS41. In use, video processor 32 analyses the video images in accordance with a preselected computerized program selected to analyze particular selected properties. The properties or information that would be analyzed by the processor would be, for example, visual blemishes, torn paper wrap, imperfections in the diameter, loose or bent parts, or missing printing on the paper wrap. When the smoking article 14 does not meet one of the preselected variables, the information is stored in the processor until the smoking article 14 moves along the conveyor belt 18 to the rejection point 34. At the rejection point 34, a blast of air in response to a signal from processor 32 will then eject the cigarette from the conveyor 18 onto, for example, slide 35 which feeds a catch bin 36** for rejected product.

Figure 3:
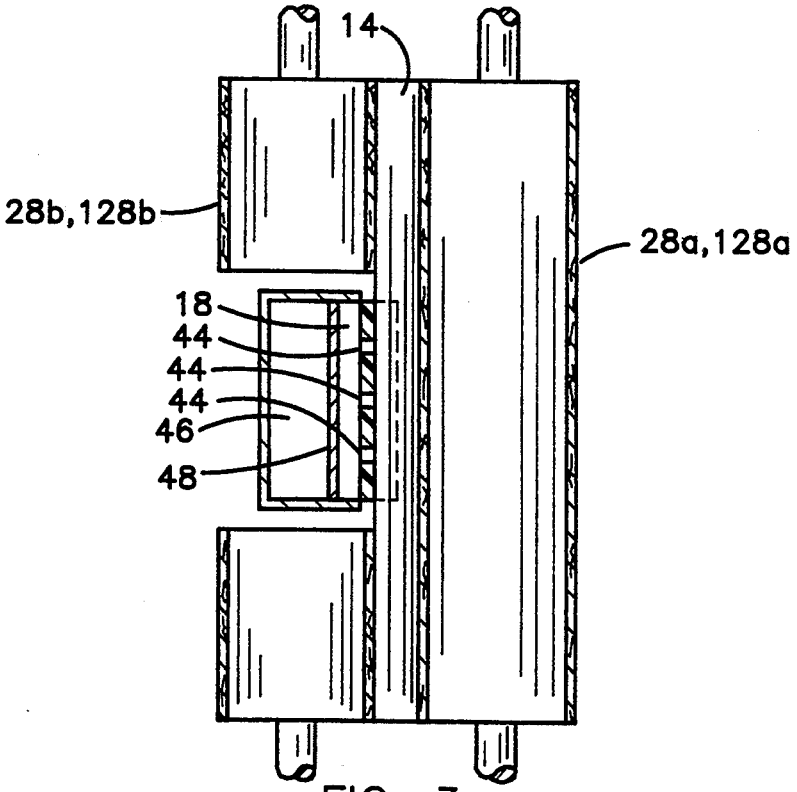

Disposed between the enclosures 20 and 120 is a pair of spaced rotating belts **28*a* and 28*b* which are disposed on opposite sides of the conveyor 18. The spacing between belts 28a and 28b are approximately the diameter of the cylindrically shaped articles 14 which are caught therebetween. The conveyor belt 28a rotates at a preselected speed slower than the conveyer 18 whereas the conveyor belt 28b rotates at substantially the same speed as the conveyor 18. Moreover, as best shown in FIGS. 2 and 3, a back-up plate 48 is provided beneath the conveyor belt 18 to prevent cigarettes from being held by the vacuum 46 thereby allowing the cigarettes to rotate freely. Belt 28a moves at a preselected speed so that the smoking articles 14 which are captured between the belts 28a and 28b are rotated 120° during the length of travel of the smoking articles 14 between the belts 28a and 28b**.

Upstream from the belts 28a and 28b are similar types of belts 128a, 128b which are of the same size and type as belts 28a and 28b and are disposed to move at the same speed as the belts 28a and 28b so that the smoking articles 14 which are caught between the belts 128a and 128 b, will also be rotated 120° during their travel between the two belts.

At the apex of the conveyor 18 are inside and outside guide members 30a and 30b, respectively, of U-shaped construction. Each of the guide members 30a, 30b is generally an arcuate flat plate member disposed in the same contour as the arcuate configuration of the apex of the conveyor 18 so as to prevent the rotational forces from lifting the cigarettes from the grooves 42 of the conveyor 18.

Downstream from the reject slide 35 is a second slide 40 which extends between the conveyor 18 and the transport conveyor 12 wherein at the location 38 the product, which has been found acceptable through the inspection process, is then discharged onto the transport conveyor 12 for further transportation to another processing operation, such as, cigarette packaging machines (now shown).

In the operation of the inspection apparatus 10 of the present invention, conveyor 12 transports random stacked cigarettes 14 to the ribbed hold conveyor 18. As the cigarettes or smoking articles 14 move vertically upward along the ribbed hold conveyor belt 18, a vacuum is applied to the underside of the belt 18 through the vacuum source or chamber 46 thereby creating a suction on the individual smoking articles 14 to hold the smoking articles 14 to the ribbed area of the conveyor 18. The smoking articles 14 continue to be transported vertically to the first position 26 at which point the video camera 22 captures a visual image of each individual smoking article 14. The enclosure 20 is provided to maintain a constant light level to the video image and light strobes 24a and 24b are positioned to stop the video image visually from moving during the image capture. The smoking articles continue to be transported on belt 18 to belts 28a and 28b wherein the smoking articles 14 are captured on these two rotating belts on each side of the conveyor 18. When the smoking articles 14 are captured between the belts 28a and 28b, plates 48 beneath the belt 18 prevents the smoking article 14 from being held by the vacuum and the smoking articles 14 will be free to rotate. Belts 28a and 28b rotate at slightly different speeds to provide a rotation of the smoking articles 14 to 120° during the entire time they are held between the belts 28a and 28b. A second video image over a second 120° of the circumference of the articles 14 is then taken at location 126 using the same type of camera and strobe lights as discussed previously in regards to taking the first image. The smoking articles 14 leave the second video image taking position 126 and move upwardly to be caught by the belts 128a and 128b which are substantially the same size and type and move at substantially the same rate of speed as belts 28a and 28b. Thus, the smoking articles 14 are rotated another 120°. Smoking articles 14 are then transported to the third image taking location identified by the numeral 226 wherein the cameras 222 and strobe lights 224a and 224b are again utilized in the same manner as those discussed previously for the taking of the first video image and herein the third or last 120° of the circumference of the smoking article 14 is photographed, the images being sent back to and analyzed by the video processor 32. As the smoking articles 14 leave the third video location 226, they move downwardly for discharge from the conveyor 18 at either the reject point 34 or the discharge 38 for good product. Each smoking article 14 passing the reject point 34 has been analyzed by the video analyzer 32 and is rejected or kept based upon the data from the processor's data bank. If the data indicates rejection, a blast of air will be delivered to force the smoking article 14 from its groove 42 and onto slide 35 wherein it is then caught in the reject product bin 36. The accepted product then continues on down the conveyor and is removed by slide 40 which feeds the accepted smoking articles back onto the transport conveyor 12.

It is realized that other variations of the preferred embodiment discussed can be made without departing from the scope and spirit of the present invention.

What is claimed is:

1. An apparatus for inspecting cylindrically shaped articles comprising:

means to feed cylindrically shaped articles to a first inspection means;

said first inspection means including means to inspect approximately 120° of the circumference of said article;

means to remove said articles from said first inspection means;

first means to rotate said articles 120°;

second inspection means including means no inspect a second 120° portion of the circumferences of said article;

means to remove said articles from said second inspection means;

means to rotate said articles 120°;

third inspection means including means to inspect a third 120° portion of the circumference of said article;

removal means from said third inspection means; and, each of said first, second, and third means to rotate said articles 120° includes a conveyor having grooves therein sized to receive said cylindrical articles, a first movable belt and a second movable belt disposed on opposite sides of said conveyor, said first belt and said second belt being in spaced relationship to each other, said spacing between said belts being equal to approximately the diameter of said cylindrical shaped articles and said second belt being in contacting relation with said articles on said conveyor, said first belt and said conveyor moving at a slower speed than said second belt whereby the cylindrically-shaped articles are rotated 120° during travel between said belts.

2. The apparatus of claim 1 wherein said first inspection means, said second inspection means and said third inspection means each include a video camera.

3. The apparatus of claim 1 including means to reject cylindrically shaped articles from said apparatus.

4. An apparatus for inspecting cylindrically shaped articles comprising:

a first inspection means, said first inspection means including means to inspect a first 120° portion of the circumference of said article;

a second inspection means, said second inspection means including means to inspect a second 120° portion oil the circumference of said article;

a third inspection means, said third inspection means including means to inspect a third 120° portion of the circumference of said articles; and, a first cylindrically shaped rotating means disposed between said first and said second inspection means and a second cylindrically shaped article rotating means disposed between said second and said third inspection means, said first and said second cylindrically shaped article rotating means includes a conveyor having grooves sized therein to receive said cylindrical articles, a first movable belt and a second movable belt disposed on opposite sides of said conveyor, said first belt and said second belt being in spaced relationship with each other, said spacing between said belts being equal to approximately the diameter of said cylindrically shaped articles and said second belt being in contacting relation with said articles on said conveyor, said first belt and said conveyor moving at a slower speed than said second belt whereby the said cylindrically shaped articles are rotated a preselected degree of rotation during travel between said belts.

5. The apparatus of claim 4 wherein said first inspection means, said second inspection means, and said third inspection means each include a video camera.

6. The apparatus of claim 4 including means to reject cylindrically shaped articles from said apparatus.

* * * * *

UNITED STATES PATENT AND TRADEMARK OFFICE

CERTIFICATE OF CORRECTION

PATENT NO. : 5,366,096

DATED : Nov. 22, 1994

INVENTOR(S) : Lewis H. Miller

It is certified that error appears in the above-indentified patent and that said Letters Patent is hereby corrected as shown below:

In Column 5, Line 10, delete "oil" and insert --of--

Signed and Sealed this

Twentieth Day of June, 1995

Bruce Lehman

*Attest:*

BRUCE LEHMAN

*Attesting Officer*

*Commissioner of Patents and Trademarks*